United States Patent [19]

Maier et al.

[11] Patent Number: 4,654,491

[45] Date of Patent: Mar. 31, 1987

[54] CIRCUIT BREAKER WITH CONTACT SUPPORT AND ARC RUNNER

[75] Inventors: Alfred E. Maier, Chippewa Township, Beaver County; Douglas C. Marks, North Braddock; David A. Leone, Aliquippa, all of Pa.

[73] Assignee: Westinghouse Electric Corp., Pittsburgh, Pa.

[21] Appl. No.: 835,670

[22] Filed: Mar. 3, 1986

[51] Int. Cl.[4] ..... H01H 33/20

[52] U.S. Cl. ..... 200/147 R; 200/144 R; 335/16; 335/147; 335/195

[58] Field of Search ..... 200/147 R, 144 R; 335/16, 195, 147

[56] References Cited

U.S. PATENT DOCUMENTS 3,555,471 1/1971 Mitskevich et al. ..... 200/147 R 4,540,961 9/1985 Maier ..... 335/195

*Primary Examiner*—Robert S. Macon

*Attorney, Agent, or Firm*—L. P. Johns

[57] ABSTRACT

A circuit breaker characterized by a movable contact on a contact-carrying arm movable between open and closed positions of a stationary contact mounted on one leg of a U-shaped conductor with another leg secured to the circuit breaker housing, a U-shaped brace between the legs and having a first support supporting and insulated from the other leg and having second supports on opposite sides of the one leg for retaining it against opposing repulsion magnetic forces due to current overloads.

9 Claims, 5 Drawing Figures

CIRCUIT BREAKER WITH CONTACT SUPPORT AND ARC RUNNER

CROSS-REFERENCE TO RELATED APPLICATIONS

This application is related to the copending application Ser. No. 835,669, filed Mar. 3, 1986, entitled "Reverse Loop Circuit Breaker With High Impedance Stationary Conductor", of which the inventors are D. A. Leone and D. C. Marks, assigned to the assignee of this application.

BACKGROUND OF THE INVENTION

1. Field of the Invention

This invention relates to circuit breakers and, more particularly, it pertains to a support for a U-shaped stationary conductor.

2. Description of the Prior Art

Circuit breakers are used extensively in industrial, residential, and commercial installations to provide protection against damage due to overcurrent conditions. An extreme overcurrent condition through a circuit breaker generates electromagnetic forces upon the contact arms sufficient to rapidly pivot them in opposite directions to separate the contacts. Thus, an arc is stretched to provide a high arc voltage and arc resistance. An accompanying trip means then rapidly releases an operating mechanism from the closed to the open position before the contact arms can return to the closed position, thereby preventing reignition of the arc. To expedite separation of the contacts, a U-shaped stationary conductor is used to get repulsion force to the moving contact. It has been found that the U-shaped conductor requires support to control its location, prevent its deflection from the moving contact pressure, as well as its deflection from the current reversing itself in the U-shape.

SUMMARY OF THE INVENTION

In accordance with this invention, a circuit breaker is provided which comprises an insulating housing having line and load terminals, a circut breaker structure within the housing and having stationary and movable contacts operable between open and closed positions and having a releasable member, a trip mechanism operable in response to the occurrence of a predetermined electric current overload to release the releasable member, the structure including a contact arm carrying the movable contact, a U-shaped conductor comprising first and second legs, the first leg being electrically connected to one of the terminals and the second leg carrying the stationary contact, the U-shaped conductor being composed of flexible metallic material and susceptible to first repulsion magnetic forces conducive to limited deflection of the legs when the circuit is closed through the circuit breaker, the contact arm and the second leg being substantially parallel and susceptible to second repulsion magnetic forces when the circuit is closed, a U-shaped brace for the conductor and including a bight portion and second and third supports, the brace extending laterally between the first and second supports, the first support being disposed next to and on the side of the first leg facing the second leg, the second support being disposed next to the second leg and having one portion on the side of the second leg facing a first leg and having a second portion on the opposite side of the second leg, an insulation strip disposed between the first support and the first leg and on the side of the second leg facing the contact arm, the insulating housing including walls forming a conductor-receiving compartment and the first support having an edge abutting an adjacent wall to prevent dislocation of the brace due to excessive repulsion magnetic forces occurring during current overload, the one portion and the stationary contact being mounted on opposite sides of the second leg, arc extinguishing means along the path of travel of the contact arm and the means including spaced arc absorbing plates, and the second portion being disposed on the second leg between the stationary contact and the arc absorbing plates.

The advantage of the circuit breaker of this invention is that it provides a U-shaped stationary conductor for generating repulsion magnetic forces between the stationary and movable contact carrying means and provides support to prevent its deflection from the moving contact pressure and its deflection from the current reversing itself within the conductor.

DESCRIPTION OF THE PREFERRED EMBODIMENT

The device of this invention pertains to a support arm for a circuit breaker. The circuit breaker may be of the type shown in U.S. Pat. No. 4,528,531 of R. H. Flick and W. K. Huffman, entitled "Molded Case Circuit Breaker With Improved Operating Mechanism", which patent is incorporated herein by reference for an understanding of a circuit breaker mechanism.

Figure 1:
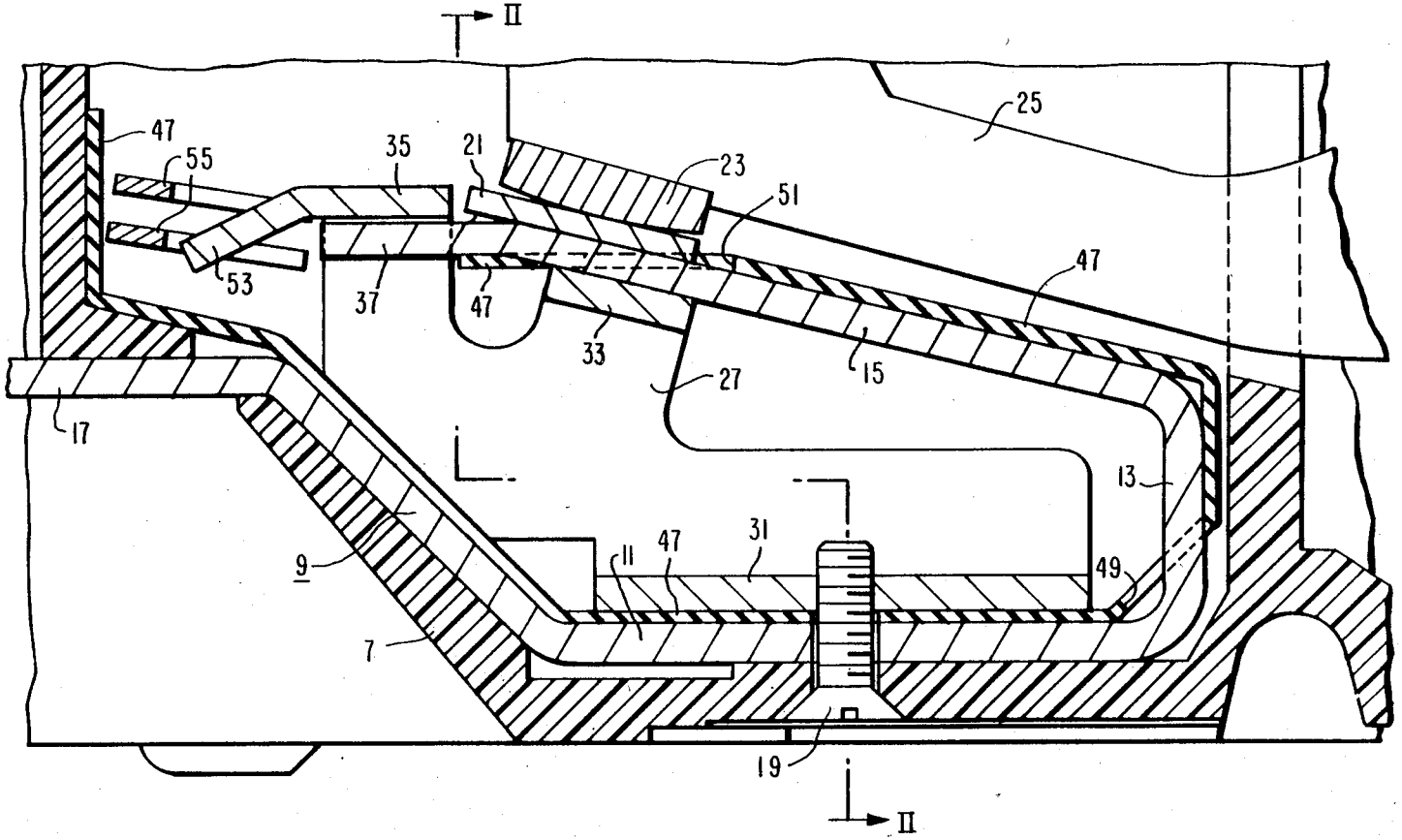
FIG. 1 is a fragmentary vertical sectional view through the contact area of a circuit breaker showing contacts in a closed position.

In the drawings, a base 7 of a molded case circuit breaker provides support for a conductor having a generally U-shaped configuration including a first leg 11, a bight portion 13, and a second leg 15 (FIG. 1). One end 17 of the conductor is a terminal end adapted for connection with a line terminal. The first leg 11 is mounted fixedly in place on the base 7 by a screw 19.

A second leg 15 supports a stationary contact 21 which is fixedly mounted in place (FIG. 1) and which cooperates with a movable contact 23 that is mounted on a movable contact-carrying arm 25. As shown in U.S. Pat. No. 4,528,531 the movable contact-carrying arm is pivotably mounted for movement between opened and closed contact positions in a conventional manner.

In accordance with this invention, the U-shaped conductor 9 is metallic and preferably composed of a copper base alloy. The U-shaped configuration of the conductor is employed to develop repulsion magnetic forces between the legs 11, 15 when the circuit between the contacts 21, 23 is closed. Likewise, opposite repulsion magnetic forces are developed between the contact-carrying arm 25 and the second leg 15, whereby the contacts are "blown open" when the magnetic forces between the leg 15 and the arm are excessive in response to predetermined overload currents.

To maintain the conductor 9 in place and to eliminate distortion of the conductor 9, a bracket 27 is provided between the legs 11, 15. The bracket 27 supports the conductor 9 to control its location, prevent its deflection from the pressure of the movable contact 23, and to prevent its deflection from the normal reversal of the AC current.

Figure 2:
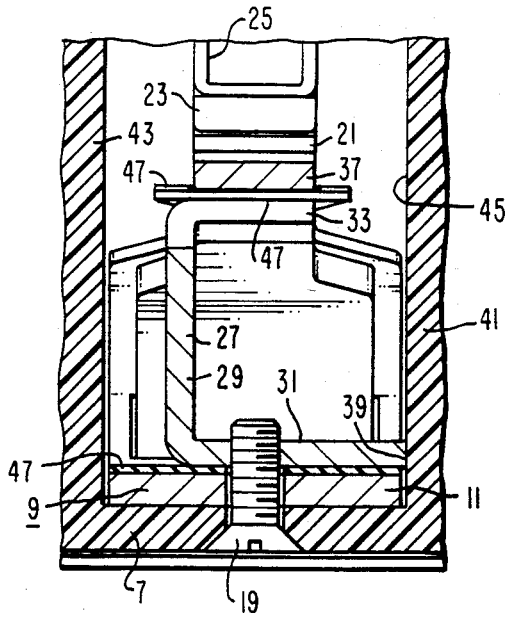
FIG. 2 is a vertical sectional view taken on the line II—II of FIG. 1.
Figure 3:
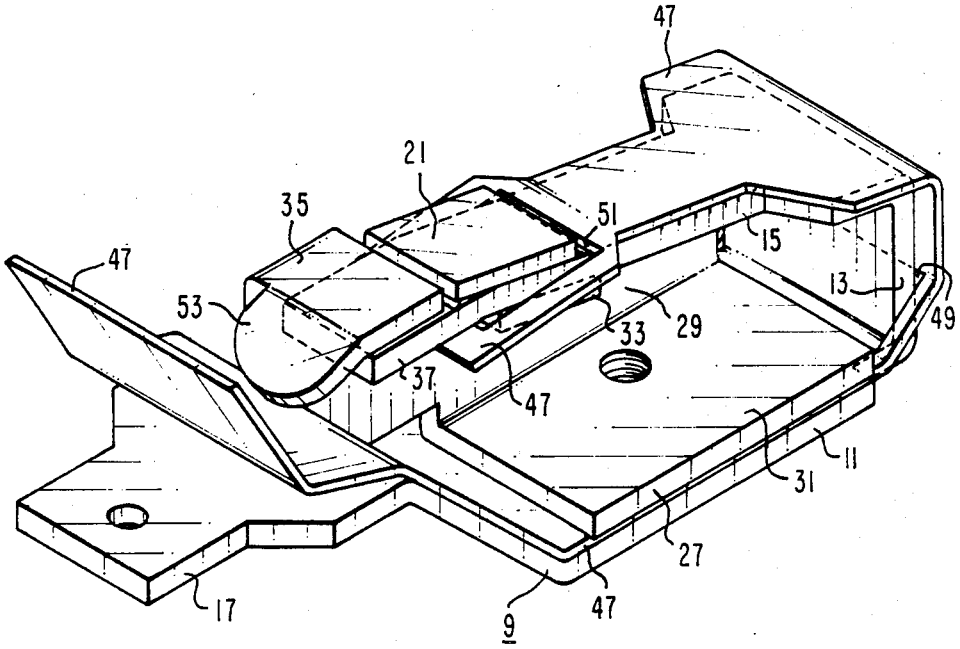
FIG. 3 is an isometric view of an assembly of the contact arm, brace, and insulation strip.

As shown in FIGS. 2 and 3, the bracket 27 is a U-shaped member including a bight portion 29, a base flange 31, and a leg brace including upper and lower flanges 33, 35. The bracket 27 is composed of a material, such as steel, having a coefficient of electrical conductivity that is significantly less than that of copper, of which the conductor 9 is composed. However, copper, being a material of relatively lower strength than that of steel, is deflectable in response to the repulsion magnetic forces occurring not only between first and second legs 11, 15, but also between the second leg 15 and the contact arm 25 (FIG. 1). Accordingly, the bracket 27 is provided primarily to support the second leg 15 and retain it from permanent deflection which would alter the required spacing between the contacts 21, 23. For this purpose, a lower flange 33 is disposed under the second leg 15, and preferably on the side of the leg opposite the stationary contact 21. The upper flange 35 is disposed across the upper side of an end portion 37 of the second leg 15. In this manner, the lower flange 33 supports the leg 15 from downward deflection and the upper flange 35 prevents the arm from upward deflection.

The bracket 27 performs an additional function. As shown in FIG. 2, the bracket 27 is secured in place by a single screw 19. In addition, the base flange 31 has an edge 39 that abuts the surface of a partition wall 41 forming, in conjunction with a space partition wall 43 and the base 7, a conductor receiving compartment 45. The screw 19 and the edge 39 retain the conductor 19 in place against possible rotation due to torsion induced by the repulsion magnetic forces indicated above.

As shown in FIGS. 1, 2, and 3, a strip 47 of insulating material, such as fiberboard, is disposed over and along the conductor 9 for insulating the several associated parts where required. Thus, the strip 47 is disposed between the first leg 11 and the base flange 31 for preventing short circuiting between the first leg and the second leg 15 at the location of the lower flange 33. The portion of the strip 47 above the second leg 15 insulates the second leg from the relatively close contactcarrying arm 25. The strip 47 is continuous and is provided with openings 49, 51 through which the conductor extends and by which the strip 47 is retained in place.

Figure 4:
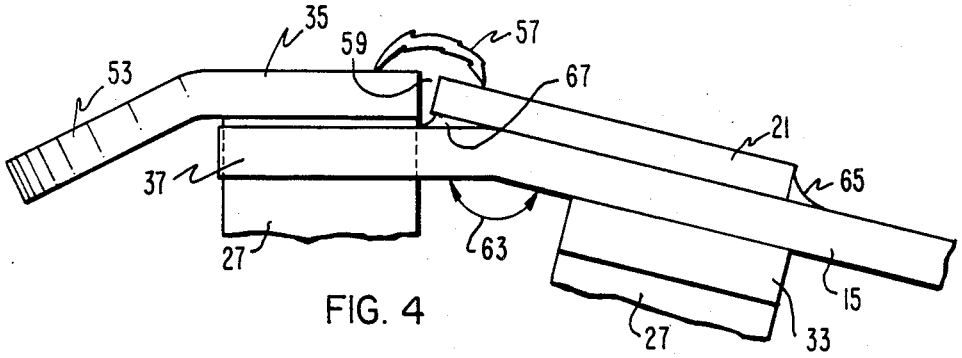
FIG. 4 is a fragmentary view showing the manner in which the stationary contact and arc runner are mounted on the contact support arm.
Figure 5:
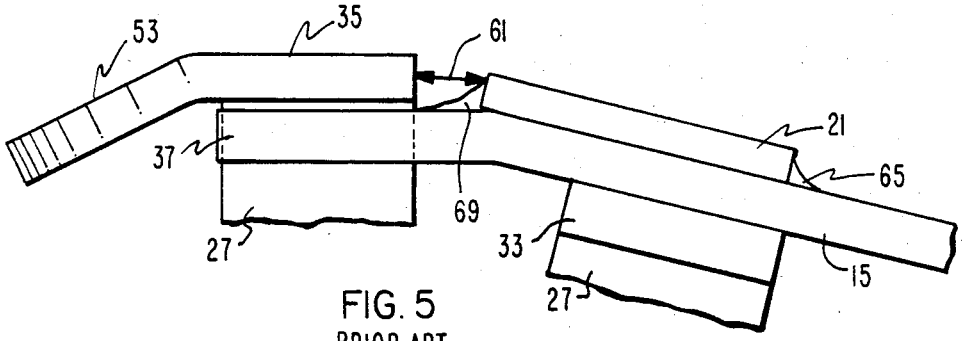
FIG. 5 PRIOR ART
FIG. 5 is a view of the prior art structure preceding that of FIG. 4.

In accordance with this invention, the bracket 27 also provides a runner 53 for an arc occurring on the stationary contact 21. For this purpose, the runner 53 (FIG. 1) extends to a position near one of a plurality of plates 55 of an arc chute of conventional construction. More particularly, as shown in FIG. 4 any arc occurring between the separating contacts 21, 23 is easily transmitted at 57 over a relatively small space 59 between the ends of the contact 21 and the upper flange 35 and from where the arc moves to the arc runner 53 to the adjacent arc plates 55. The spacing 59 is diminished over a spacing 61 prior construction (FIG. 5) due to the relocation of the stationary contact 21 (FIG. 4). Inasmuch as the end portion 37 of the conductor 15 is disposed at an angle 63, the left end portion of the contact 21 may be mounted on the conductor 15 by brazing fillets 65, 67, the latter of which is disposed in an angular spacing between the end portion 37 and the projecting part of the stationary contact 21. Thus, unlike a fillet 69 in the prior art construction (FIG. 5) which prevented filter placement of the upper flange 35 to the contact 21, the smaller spacing 59 (FIG. 4) facilitated transfer of the arc 57 from the contact 21 and thereby prevents excessive burning of the contact such as in the prior art structure.

In conclusion, the device of this invention accommodates the reverse loop path of current as it moves first through the U-shaped conductor and then through the contact mounting arm. First, in the U-shaped conductor, the contacts are separated by excessive repulsion magnetic forces incurred by high overload circuit currents. Similar forces between the conductor and the contact arm drive the arm upward and, without the bracket, would force the lower arm down. Moreover, the lower part of the reverse loop generates a force to push the upper part of the conductor upwardly, for which reason restraint of movement of the arm in both directions is provided. Finally, twisting of the assembly of the bracket and U-shaped conductor is avoided by placement of one end of the bracket against the partition wall of the molded insulating housing.

What is claimed is:

1. A circuit breaker comprising:

an insulating housing having line and load terminals;

a circuit breaker structure within the housing and having stationary and movable contacts operable between open and closed positions;

the structure including a releasable member;

a trip mechanism movable in response to the occurrence of a predetermined electric current overload to release the releasable member;

the circuit breaker structure including a contact arm carrying the movable contact;

a U-shaped conductor comprising first and second legs;

the first leg being electrically connected to one of the terminals and the second leg carrying the stationary contact;

the U-shaped conductor being composed of flexible metallic material and susceptible to first repulsion magnetic forces conducive to limited deflection of the legs when the circuit is closed through the circuit breaker;

the contact arm and the second leg being substantially parallel and susceptible to second repulsion magnetic forces when the circuit is closed;

a U-shaped bracket for the conductor and including a bight portion and a base flange and a support flange for the second leg;

the base flange being disposed next to and on the side of the first leg facing the second leg; and the support flange being disposed next to the second leg and having a lower flange on the side of the second leg facing the first leg and having an upper flange on the opposite side of the second leg.

2. The circuit breaker of claim 1 in which the bight portion extends laterally between the base and support flanges.

3. The circuit breaker of claim 2 in which insulation is disposed between the base flange and the first leg and on the side of the second leg facing the contact arm.

4. The circuit breaker of claim 3 in which the insulating housing includes walls forming a conductor-receiving compartment and the base flange having an edge abutting an adjacent wall to prevent dislocation of the bracket due to excessive repulsion magnetic forces incurred during current overload.

5. The circuit breaker of claim 4 in which the lower flange and the stationary contact are mounted on opposite sides of the second leg.

6. A circuit breaker comprising:

an insulating housing;

a circuit breaker structure within the housing and having stationary and movable contacts operable between open and closed positions;

a contact arm carrying the movable contact through a path of travel between open and closed positions;

arc-extinguishing means along the path of travel of the contact arm and the means including spaced arc-absorbing plates;

a trip mechanism movable in response to the occurrence of a predetermined electric current overload to cause the circuit breaker structure to move the contact arm to the open position;

a U-shaped conductor including first and second legs;

the first leg being mounted on the housing and the second leg mounting the stationary contact;

the U-shaped conductor being composed of flexible metallic material and susceptible to first repulsion magnetic forces conducive to limited deflection of the legs when the circuit is closed through the contacts;

the contact arm and the second leg being susceptible to second repulsion magnetic forces when the circuit is closed;

a U-shaped bracket for the conductor and including a bight portion and a base flange and a support flange for the second leg;

the base flange being disposed next to and insulated from the first leg and on the side of the first leg facing the second leg;

the support flange being disposed next to the second leg and having a lower flange on the side of the second leg facing the first leg and having an upper flange on the opposite side thereof; and the upper flange being located on the second leg proximate to the stationary contact and having an arc runner extending toward the arc-absorbing plates.

7. The circuit breaker of claim 6 in which the second leg includes an end portion inclined at an angle to the second leg and forming a space between the end portion and the stationary contact, a metallurgical bond in the space, and an arc runner on the end portion adjacent to the stationary contact.

8. The circuit breaker of claim 6 in which the upper flange is disposed on the second leg between the stationary contact and the arc-absorbing plates.

9. The circuit breaker of claim 8 in which the bight portion extends substantially perpendicularly to the upper and lower flanges to reinforce the U-shaped conductor when the repulsion forces occur due to overload circuit currents.

* * * * *